US010307032B2

(12) United States Patent
Alstad

(10) Patent No.: US 10,307,032 B2
(45) Date of Patent: Jun. 4, 2019

(54) CLEANSING APPARATUS AND SYSTEMS

(71) Applicant: Shawn R. Alstad, Phoenix, AZ (US)

(72) Inventor: Shawn R. Alstad, Phoenix, AZ (US)

(73) Assignee: Shawn R. Alstad, Phoenix, AZ (US)

( * ) Notice: Subject to any disclaimer, the term of this patent is extended or adjusted under 35 U.S.C. 154(b) by 440 days.

(21) Appl. No.: 15/166,830

(22) Filed: May 27, 2016

(65) Prior Publication Data

US 2016/0353962 A1 Dec. 8, 2016

Related U.S. Application Data

(60) Provisional application No. 62/171,958, filed on Jun. 5, 2015.

(51) Int. Cl.

| | |
|---|---|
| ***A47L 13/17*** | (2006.01) |
| ***A47L 13/42*** | (2006.01) |
| ***B08B 1/00*** | (2006.01) |

(52) U.S. Cl.

CPC ..... *A47L 13/17* (2013.01); *A47L 13/42* (2013.01); *B08B 1/00* (2013.01)

(58) Field of Classification Search

CPC ..... A47L 13/17; A47L 13/16; A47L 13/42; B08B 1/00; A47K 7/024

See application file for complete search history.

(56) References Cited

U.S. PATENT DOCUMENTS

| | | | | |
|---|---|---|---|---|
| 2,901,760 | A * | 9/1959 | Nelson | A47K 3/001 15/160 |
| 2,904,038 | A * | 9/1959 | Hackney | A47K 7/024 15/110 |
| 5,072,480 | A * | 12/1991 | Peters | A47K 7/024 15/110 |
| 5,673,785 | A * | 10/1997 | Schlaak | H01H 59/0009 200/181 |
| 5,784,722 | A * | 7/1998 | Ureta | A47K 7/024 4/606 |
| 6,370,722 | B1 * | 4/2002 | Duckworth | A47K 7/024 15/104.92 |
| 6,647,564 | B1 * | 11/2003 | Smith | A47K 7/024 15/176.5 |
| 7,578,021 | B1 * | 8/2009 | Figueroa | A47K 7/024 15/104.92 |
| 9,049,973 | B1 * | 6/2015 | Arrieta | A47L 13/16 |

(Continued)

*Primary Examiner* — Weilun Lo

(74) *Attorney, Agent, or Firm* — Griffiths & Seaton PLLC

(57) ABSTRACT

Cleansing apparatus and systems are provided. One cleansing apparatus includes a perimeter surface defining an enclosed area, a first surface defining a first side and including a first plane coupled to and adjacent the perimeter surface, and a second surface opposite the first surface and defining a second side including a second plane coupled to and adjacent the perimeter surface. The enclosed area includes a spring connected to the perimeter surface, wherein the spring is engageable on one of the first side and the second side and extends beyond the one of the first plane and the second plane when engaged, the spring is defined and resides within the enclosed area when disengaged, and the spring is retractable within the one of the first plane and the second plane when disengaged. A system includes the above spring and an attachment mechanism for attaching the cleansing apparatus to a foreign surface.

12 Claims, 6 Drawing Sheets

(56) References Cited

U.S. PATENT DOCUMENTS

| | | | | |
|---|---|---|---|---|
| 2005/0091776 | A1* | 5/2005 | Orban | A47K 7/024 15/210.1 |
| 2006/0010635 | A1* | 1/2006 | Varner | A47L 1/06 15/245 |
| 2009/0145459 | A1* | 6/2009 | Gonzales | A47L 13/16 134/6 |
| 2009/0276971 | A1* | 11/2009 | Nozari | A47L 13/16 15/118 |
| 2010/0122426 | A1* | 5/2010 | Aguilar | A47K 7/024 15/209.1 |
| 2017/0172358 | A1* | 6/2017 | Sainio | A47K 7/024 |

* cited by examiner

CLEANSING APPARATUS AND SYSTEMS

BACKGROUND OF THE INVENTION

Field of the Invention

The present invention relates generally to cleansing apparatus and systems.

Description of the Related Art

Presently, there are numerous devices for cleaning various types of surfaces. Some examples of such cleaning devices include: a sponge, scrubbing pad, wired pad, and the like cleaning devices. While these devices are simple and effective, there are several drawbacks to these devices.

One drawback of these cleaning devices is that they typically absorb water, which encourages the growth and spread of harmful bacteria, especially at the next use of the cleaning devices. Furthermore, the material used to construct these cleaning devices are not anti-bacterial, which only adds to and/or further encourages the growth of bacteria on these cleaning devices. In addition, the configuration of these cleaning devices encourages the user to leave these in a sink or on another surface that is exposed to water and/or bacteria, which further encourages the growth and spread of harmful bacteria. Therefore, a cleansing apparatus and/or system to address these drawbacks is needed.

SUMMARY OF THE INVENTION

Various embodiments provide cleansing apparatus and systems. One cleansing apparatus comprises a perimeter surface defining an enclosed area, a first surface defining a first side and including a first plane coupled to and adjacent the perimeter surface, and a second surface opposite the first surface and defining a second side including a second plane coupled to and adjacent the perimeter surface. In one embodiment, the enclosed area comprises a spring coupled to the perimeter surface, wherein: the spring is engageable on one of the first side and the second side and extends beyond the one of the first plane and the second plane when engaged, the spring is defined and resides within the enclosed area when disengaged, and the spring is retractable within the first plane or the second plane when disengaged. In various embodiments, the cleansing apparatus further comprises an attachment mechanism coupled to the spring, the attachment mechanism configured for attaching the cleansing apparatus to a foreign surface.

Another cleansing apparatus, comprises a perimeter surface defining an enclosed area, a first surface defining a first side and including a first plane coupled to and adjacent the perimeter surface, and a second surface opposite the first surface and defining a second side including a second plane coupled to and adjacent the perimeter surface. In various embodiments, the enclosed area comprises a spring coupled to the perimeter surface, wherein: the spring is engageable on the first side extends beyond the first plane when engaged, the spring is defined and resides within the enclosed area when disengaged, and the spring is retractable within the first plane when disengaged. In one embodiment, the perimeter surface, the first surface, the second surface, and the spring are each comprised of silicon and are formed as a single unit. The cleansing apparatus, in various embodiments, further comprises a suction cup coupled to the spring and configured for attaching the cleansing apparatus to a foreign surface, wherein: the suction cup comprises a suction force, the spring comprises a spring force, and the suction force is greater than the spring force when the suction cup is attached to the foreign surface and the spring is engaged.

One system comprises a spring formed on a cleansing apparatus. The spring is defined and resides within a side of the cleansing apparatus when disengaged, is engageable on the side and extends beyond a plane of the side when engaged, and is retractable within the plane when disengaged. The system further comprises an attachment mechanism coupled to the spring and configured for attaching the cleansing apparatus to the foreign surface.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE DRAWINGS

Various embodiments disclosed below provide a cleansing apparatus. Various other embodiments provide systems for attaching the cleansing apparatus to a foreign surface.

Figure 1:
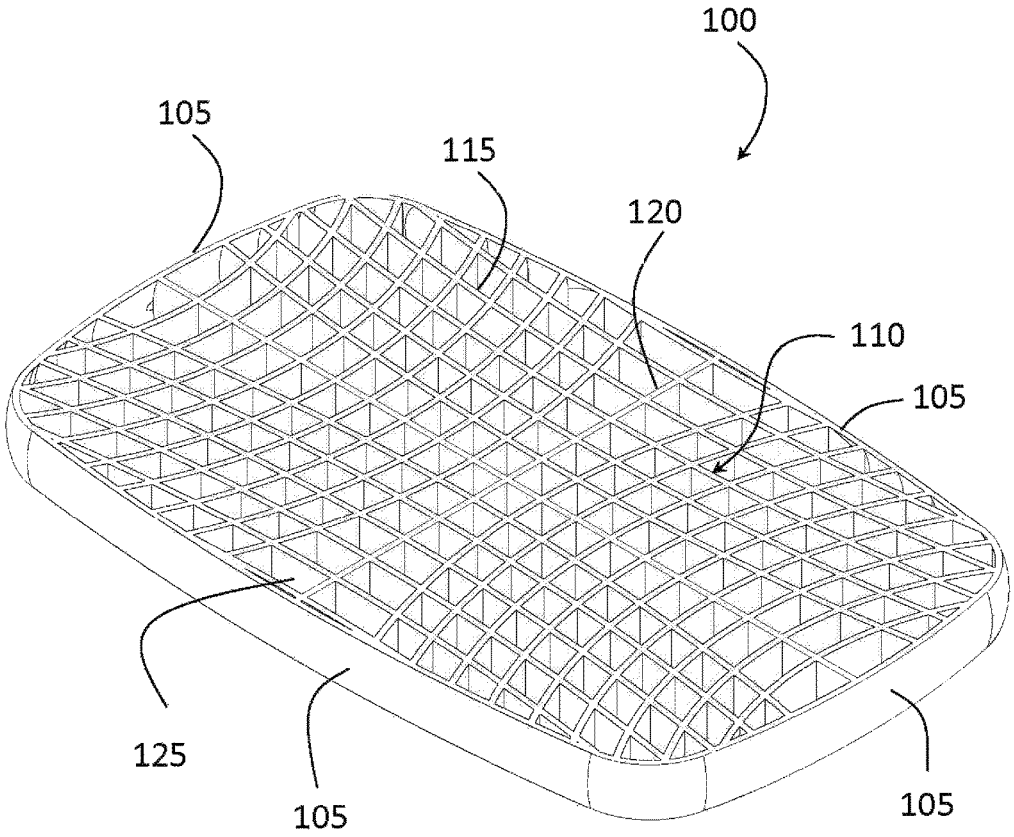
FIG. 1 is a diagram of one embodiment of a cleansing apparatus.

Turning now to the figures, FIG. 1 is a diagram of one embodiment of a cleansing apparatus 100. At least in the illustrated embodiment, cleansing apparatus 100 comprises an outer perimeter 105 defining an enclosed area 110 for cleaning various surfaces.

Outer perimeter 105, in various embodiments, comprises any shape suitable for enabling a user to utilize cleansing apparatus 100. In one embodiment, outer perimeter 105 includes an ergonomic shape to enable a user to easily grip cleansing apparatus 100. For example, outer perimeter 105 may include a round shape (e.g., a circle, oval, etc.), a triangular shape, a quadrilateral shape, an hourglass shape, a shape that includes more than four sides (e.g., a pentagon, a hexagon, etc.), or the like shapes.

In various embodiments, outer perimeter 105 comprises a whimsical shape. That is, outer perimeter 105 includes a shape that makes cleansing apparatus more enjoyable to use. Examples of whimsical shapes include, but are not limited to, vehicles (e.g., an automobile, a truck, a train, an airplane, a helicopter, a ship/boat, a submarine, a spacecraft, a bicycle, and the like vehicles), animals, birds, sea creatures, humans (e.g., a police officer, a firefighter, etc.), caricatures, cartoon characters, plants/trees/flowers, symbols (e.g., a four leaf clover, a dollar sign, etc.), inanimate objects (e.g., a building, a rock formation, a historic monument, a good luck charm, etc.), and the like whimsical shapes.

Coupled to outer perimeter 105 and within enclosed area 110 is a pattern of ribs 115 and ribs 120 that form one or more apertures 125 comprising any type of pattern and/or shape known in the art or developed in the future. At least in the illustrated embodiment, cleansing apparatus 100 comprises a plurality of ribs 115 forming a plurality of rows and a plurality of ribs 120 forming a plurality of columns creating a plurality of box-shaped apertures 125. In other embodiments, ribs 115 and ribs 120 are formed to create a plurality of apertures 125 with a honeycomb shape or the like shape.

Furthermore, apertures 125 may comprise any dimensions that enable material (e.g., a liquid, soap, particles, debris, etc.) to transport from one side to the other side of cleansing device 100 when in use. That is, apertures 125 may be relatively small apertures up to and including large apertures. In various embodiments, apertures 125 are all the same size. In other embodiments, at least two apertures 125 include different sizes. In still other embodiments, three or more apertures 125 include different sizes. In yet other embodiments, each aperture 125 includes a different size.

Outer perimeter 105, in various embodiments, includes a height/depth in the range of about 0.25 inches to about 1.0 inch. Here, rib(s) 115 and rib(s) 120 extend the entire height/depth of outer perimeter 105 (e.g., from a top side to a bottom side of cleaning apparatus 100). Similarly, aperture(s) 125 extend the entire height/depth of outer perimeter 105.

In the various embodiments, outer perimeter 105 includes any size area that is practical enough to enable to human to effectively and/or efficiently utilize cleansing apparatus 100. That is, outer perimeter 105 may include any practical dimensions formed from any length and width, circumference/diameter/radius, base and height, and the like dimensions. In one embodiment, outer perimeter 105 includes a length in the range of about 2.0 inches to about 6.0 inches and a width in the range of about 2.0 inches to about 6.0 inches. In another embodiment, outer perimeter 105 includes a diameter in the range of about 2.0 inches to about 6.0 inches. In yet another embodiment (e.g., a triangle), outer perimeter 105 includes base in the range of about 2.0 inches to about 6.0 inches and a height in the range of about 2.0 inches to about 6.0 inches.

Cleansing apparatus 100 (e.g., outer perimeter 105, enclosed area 110, and/or ribs 115/120) comprises any material known in the art or developed in the future that is non-absorbent and/or anti-bacterial. In one embodiment, cleansing apparatus 100 is comprised of silicon. In an aspect of this embodiment, the silicon is flexible and/or substantially non-rigid in nature. In various embodiments, cleansing apparatus 100 comprises a hardness range of about 10 to about 80 durometer Shore A.

In another aspect, the silicon is an elastomer (e.g., a rubber-like material) composed of silicone, itself a polymer, comprising silicon together with carbon, hydrogen, and oxygen. This material is substantially odorless, tasteless, hypoallergenic, and includes an inorganic backbone. This material is hygienic and is resistant to bacteria and/or mold growth and includes a large range of resistance to harsh chemicals. The silicon comprises a high biocompatibility, is thermally stable with temperature range performances that may be obtained between about −148° F. and about 572° F. This large thermal range makes cleansing apparatus 100 dishwasher and washing machine safe. Cleansing apparatus 100 is also ozone safe and ultra violet safe if left outside and/or exposed to the elements.

Cleansing apparatus 100 may include any color known in the art or developed in the future. In one embodiment, cleansing apparatus 100 comprises a single color. In other embodiments, cleansing apparatus 100 comprises two or more colors.

In one embodiment, cleansing apparatus 100 is fabricated via a Liquid Injection Molding (LIM) technique using a Liquid Silicone Rubber (LSR). LIM with LSR provides a cycle time of about 5 seconds to about 6 seconds per cavity per machine, which enables the mass production of cleansing apparatus 100. Standard mold draft angles of about 5 degrees and/or greater may also be used, but are not necessary with LSR. Multi-part injection or over molding may also be utilized to provide various durometers with multiple colors within the same product. Deep thin walled ribs 115/120 may also be created with this process.

One process includes a part A component (e.g., silicon) and a part B component (e.g., carbon, hydrogen, and oxygen) that are mixed prior to the injection process. Another process includes a one-part silicone material being injection molded.

Various mold design techniques may be used to create cleansing apparatus 100. Examples of mold design techniques include, but are not limited to: cold runners, ejector pins, and ejector plates. Other variables that may be controlled to obtain fast cycle times with consistent product quality are silicone and mold injection temperatures, pressures, injection velocities, hold times, mold cooling, and the like techniques that are known in the art or developed in the future.

Figure 2:
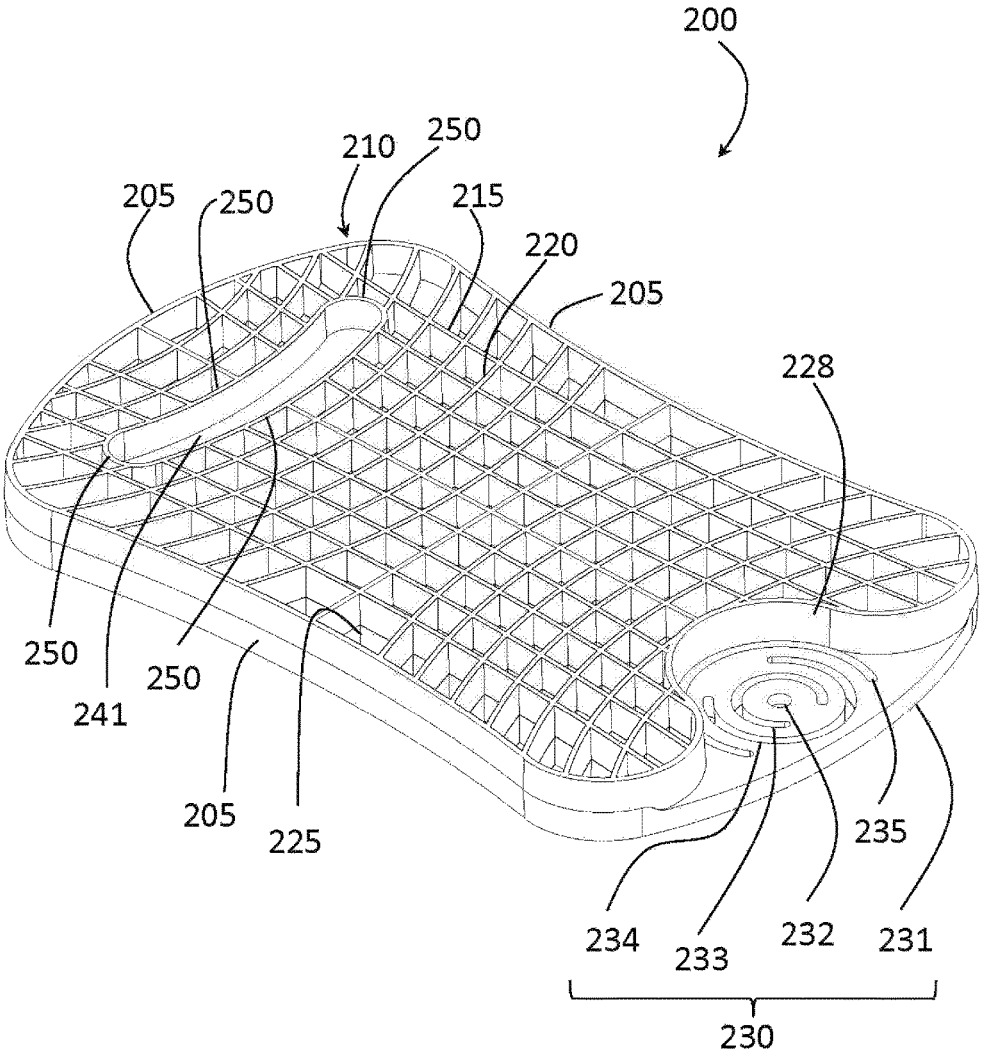
FIG. 2 is a diagram of an embodiment of a cleansing apparatus comprising a spring system.

With reference to FIG. 2, FIG. 2 is a diagram of another embodiment of a cleansing apparatus 200. At least in the illustrated embodiment, cleansing apparatus 200 comprises an outer perimeter 205 defining an enclosed area 210 similar to outer perimeter 105 and enclosed area 210 in FIG. 1 and further comprising a spring system 230 and an inner perimeter 250.

Outer perimeter 205, in various embodiments, comprises any shape suitable for enabling a user to utilize cleansing apparatus 200. In one embodiment, outer perimeter 205 includes an ergonomic shape to enable a user to easily grip cleansing apparatus 200. For example, outer perimeter 205 may include a round shape (e.g., a circle, oval, etc.), a triangular shape, a quadrilateral shape, an hourglass shape, a shape that includes more than four sides, or the like shapes.

In various embodiments, outer perimeter 205 comprises a whimsical shape. That is, outer perimeter 205 includes a shape that makes cleansing apparatus more enjoyable to use. Examples of whimsical shapes include, but are not limited to, vehicles (e.g., an automobile, a truck, a train, an airplane, a helicopter, a ship/boat, a submarine, a spacecraft, a bicycle, and the like vehicles), animals, birds, sea creatures, humans (e.g., a police officer, a firefighter, etc.), caricatures, cartoon characters, plants/trees/flowers, symbols (e.g., a four leaf clover, a dollar sign, etc.), inanimate objects (e.g., a building, a rock formation, a historic monument, a good luck charm, etc.), and the like whimsical shapes.

Coupled to outer perimeter 205 and within enclosed area 210 is a pattern of ribs 215 and ribs that form one or more apertures 225 comprising any type of pattern and/or shape known in the art or developed in the future. At least in the illustrated embodiment, cleansing apparatus 200 comprises a plurality of ribs 215 forming a plurality of rows and a plurality of ribs 220 forming a plurality of columns creating a plurality of box-shaped apertures 225. In other embodiments, ribs 215 and ribs 220 are formed to create a plurality of apertures 225 with a honeycomb shape and the like shape.

Furthermore, apertures 225 may comprise any dimensions that enable material (e.g., a liquid, soap, particles, debris, etc.) to transport from one side to the other side of cleansing device 200 when in use. That is, apertures 225 may be relatively small apertures up to and including large apertures. In various embodiments, apertures 225 are all the same size. In other embodiments, at least two apertures 225 include different sizes. In still other embodiments, three or more apertures 225 include different sizes. In yet other embodiments, each aperture 225 includes a different size.

Outer perimeter 205, in various embodiments, includes a height/depth in the range of about 0.25 inches to about 1.0 inch. Here, rib(s) 215 and rib(s) 220 extend the entire height/depth of outer perimeter 205 (e.g., from a top side to a bottom side of cleaning apparatus 200). Similarly, aperture(s) 225 extend the entire height/depth of outer perimeter 205.

In the various embodiments, outer perimeter 205 includes any size area that is practical enough to enable to human to effectively and/or efficiently utilize cleansing apparatus 200. That is, outer perimeter 205 may include any practical dimensions formed from any length and width, circumference/diameter/radius, base and height, and the like dimensions. In one embodiment, outer perimeter 205 includes a length in the range of about 2.0 inches to about 6.0 inches and a width in the range of about 2.0 inches to about 6.0 inches. In another embodiment, outer perimeter 205 includes a diameter in the range of about 2.0 inches to about 6.0 inches. In yet another embodiment (e.g., a triangle), outer perimeter 205 includes base in the range of about 2.0 inches to about 6.0 inches and a height in the range of about 2.0 inches to about 6.0 inches.

Outer perimeter 205 further comprises a curved portion 228 configured to facilitate the formation and function of spring system 230. Spring system 230 comprises a platform portion 231, an aperture 232, and channels 233, 234, and/or 235.

Platform portion 231 is configured for coupling spring system 230 to the other portions of cleansing apparatus 200 and for providing a stable base upon which to engage spring system 230. Aperture 232 is configured for coupling an attachment mechanism (e.g., a suction cup, a hook, hook and loop tape, a clip, a fastener, etc.) to spring system 230.

Channels 233, 234, and/or 235 form the loop(s) of a spring and are flexible such that the portions of spring system 230 proximate to channels 233, 234, and/or 235 are able to extend above/beyond platform portion 231 when spring system 230 is engaged and flexibly return substantially flush with platform portion 231 when spring system 230 is not engage or disengaged. While spring system 230 is shown with channels 233, 234, and 235, spring system 230 is not limited to this configuration. That is, spring system 230 may include any number of channels. In other words, spring system 230 includes one or more channels to create a spring.

Spring system 230, in various embodiments, is formed of the same material as cleansing apparatus 200 such that spring system 230 and the other portions of cleansing apparatus 200 are and/or form a single unit. In other embodiments, spring system 230 may be formed of a different material than cleansing apparatus 200 such that spring system 230 and the other portions of cleansing apparatus 200 are different pieces coupled together to form a single unit.

In various embodiments, internal perimeter 250 is coupled to a membrane 241 to provide a platform without ribs creating space for text, logos or images that may be embossed, engraved, painted, or stamped to provide the product name and/or company branding/advertising. Membrane 241 also blocks a portion of aperture(s) 225 to provide a container to help capture dispensed soap.

Cleansing apparatus 200 (e.g., outer perimeter 205, enclosed area 210, ribs 215/220, spring system 230, and/or inner perimeter 250) comprises any material known in the art or developed in the future that is non-absorbent and/or anti-bacterial. In one embodiment, cleansing apparatus 200 is comprised of silicon. In an aspect of this embodiment, the silicon is flexible and/or substantially non-rigid in nature. In various embodiments, cleansing apparatus 200 comprises a hardness range of about 10 to about 80 durometer Shore A.

In another aspect, the silicon is an elastomer (e.g., a rubber-like material) composed of silicone, itself a polymer, comprising silicon together with carbon, hydrogen, and oxygen. This material is substantially odorless, tasteless, hypoallergenic, and includes an inorganic backbone. This material is hygienic and is resistant to bacteria and/or mold growth and includes a large range of resistance to harsh chemicals. The silicon comprises a high biocompatibility, is thermally stable with temperature range performances that may be obtained between about −148° F. and about 572° F. This large thermal range makes cleansing apparatus 100 dishwasher and washing machine safe. Cleansing apparatus 200 is also ozone safe and ultra violet safe if left outside and/or exposed to the elements.

Cleansing apparatus 200 may include any color known in the art or developed in the future. In one embodiment, cleansing apparatus 200 comprises a single color. In other embodiments, cleansing apparatus 200 comprises two or more colors.

In one embodiment, cleansing apparatus 200 is fabricated via a Liquid Injection Molding (LIM) technique using a Liquid Silicone Rubber (LSR). LIM with LSR provides a cycle time of about 5 seconds to about 6 seconds per cavity per machine, which enables the mass production of cleansing apparatus 200. Standard mold draft angles of about 5 degrees and/or greater may also be used, but are not necessary with LSR. Multi-part injection or over molding may also be utilized to provide various durometers with multiple colors within the same product. Deep thin walled ribs 215/220 may also be created with this process.

One process includes a part A component (e.g., silicon) and a part B component (e.g., carbon, hydrogen, and oxygen) that are mixed prior to the injection process. Another process includes a one-part silicone material being injection molded.

Various mold design techniques may be used to create cleansing apparatus 200. Examples of mold design techniques include, but are not limited to: cold runners, ejector pins, and ejector plates. Other variables that may be controlled to obtain fast cycle times with consistent product quality are silicone and mold injection temperatures, pressures, injection velocities, hold times, mold cooling, and the like techniques that are known in the art or developed in the future.

Figure 3:
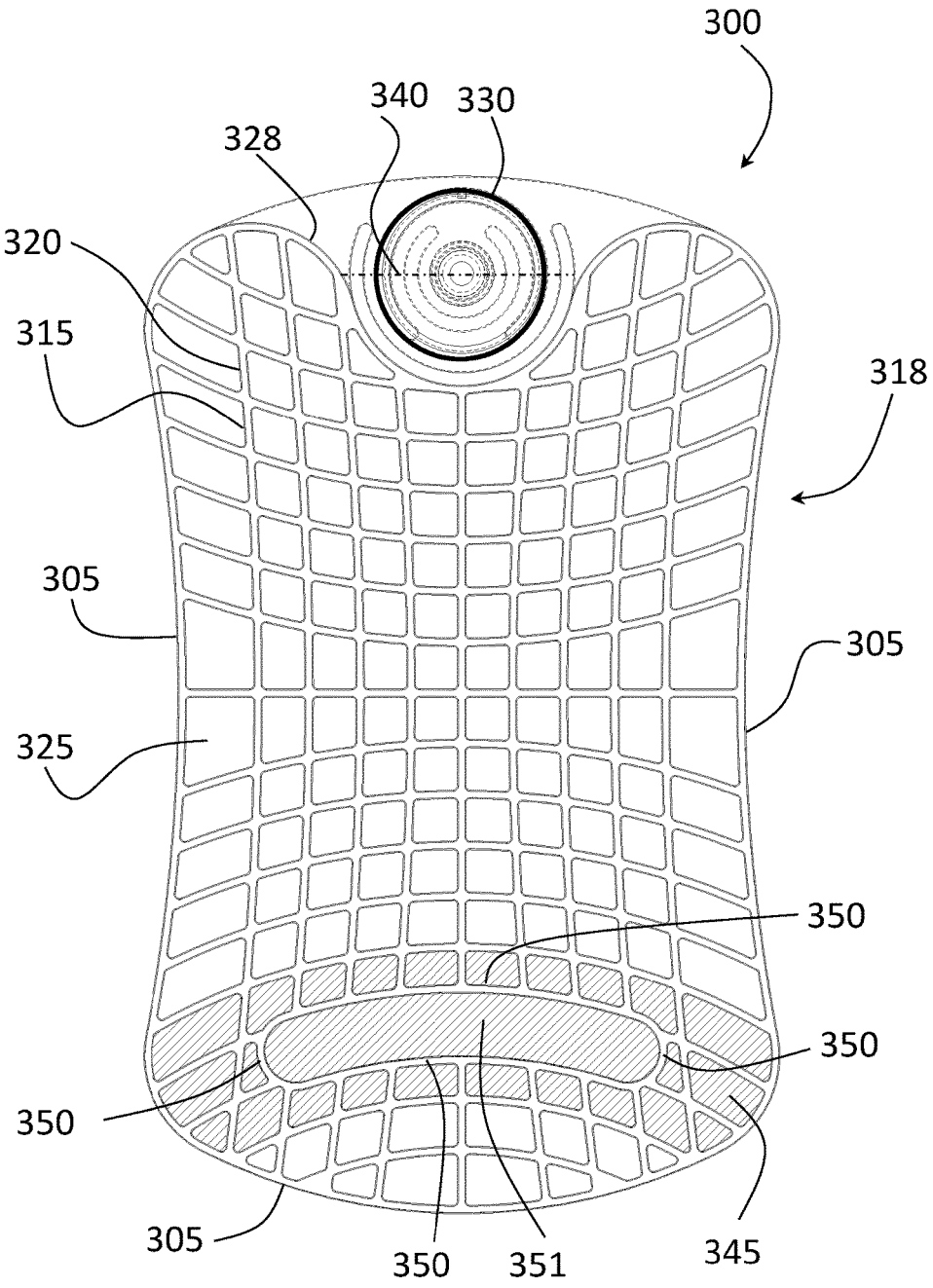
FIG. 3 is a diagram of another embodiment of a cleansing apparatus comprising an attachment/spring system and one or more cavities.

Turning now to FIG. 3, FIG. 3 is a diagram of another embodiment of a cleansing apparatus 300. At least in the illustrated embodiment, cleansing apparatus 300 comprises an outer perimeter 305 defining an enclosed area 310, a spring system 330, and an inner perimeter 350 similar to outer perimeters 105/205 defining enclosed areas 110/210, spring systems 130/230, and inner perimeter 350 in FIGS. 1 and/or 2. As further illustrated in FIG. 3, cleansing apparatus 300 comprises an attachment mechanism 340 and filled area(s) 345 and 351 coupled to the other portions of cleansing apparatus 300.

Outer perimeter 305, in various embodiments, comprises any shape suitable for enabling a user to utilize cleansing apparatus 300. In one embodiment, outer perimeter 305 includes an ergonomic shape to enable a user to easily grip cleansing apparatus 300. For example, outer perimeter 305 may include a round shape (e.g., a circle, oval, etc.), a triangular shape, a quadrilateral shape, an hourglass shape, a shape that includes more than four sides, or the like shapes and similar shapes may be included with inner perimeter 350.

In various embodiments, outer perimeter 305 comprises a whimsical shape. That is, outer perimeter 305 includes a shape that makes cleansing apparatus more enjoyable to use. Examples of whimsical shapes include, but are not limited to, vehicles (e.g., an automobile, a truck, a train, an airplane, a helicopter, a ship/boat, a submarine, a spacecraft, a bicycle, and the like vehicles), animals, birds, sea creatures, humans (e.g., a police officer, a firefighter, etc.), caricatures, cartoon characters, plants/trees/flowers, symbols (e.g., a four leaf clover, a dollar sign, etc.), inanimate objects (e.g., a building, a rock formation, a historic monument, a good luck charm, etc.), and the like whimsical shapes and similar shapes may be included with inner perimeter 350.

Coupled to outer perimeter 305 and within enclosed area 310 is a pattern of ribs 315 and ribs 320 that form one or more apertures 325 comprising any type of pattern and/or shape known in the art or developed in the future. At least in the illustrated embodiment, cleansing apparatus 300 comprises a plurality of ribs 315 forming a plurality of rows and a plurality of ribs 320 forming a plurality of columns creating a plurality of box-shaped apertures 325. In other embodiments, ribs 315 and ribs 320 are formed to create a plurality of apertures 325 with a honeycomb shape and the like shape.

Furthermore, apertures 325 may comprise any dimensions that enable material (e.g., a liquid, soap, particles, debris, etc.) to transport from one side to the other side of cleansing device 300 when in use. That is, apertures 325 may be relatively small apertures up to and including large apertures. In various embodiments, apertures 325 are all the same size. In other embodiments, at least two apertures 325 include different sizes. In still other embodiments, three or more apertures include different sizes. In yet other embodiments, each aperture 325 includes a different size.

As illustrated in FIG. 3, enclosed area comprises one or more filled areas 345 and 351. Filled area(s) 345 and 351 may be fully filled and/or partially filled to create a greater surface area for cleaning a foreign surface. In at least some embodiments, filled area(s) 345 and 351 are formed similar to apertures 345, but are filled and/or partially filled with the same material and/or a different material as the other portions of cleansing apparatus 300.

In various embodiments, filled area(s) 345 and 351 may form any pattern and/or shape that increases the cleaning surface area of cleansing apparatus 300. Furthermore, though FIG. 3 illustrates that filled areas 345 and 351 are all adjacent/proximate to one another and define a single filled and/or partially filled location, other embodiments include filled areas 345 oriented in locations non-adjacent to each other and define multiple filled and/or partially filled locations.

In one embodiment, filled areas 345 and 351 are all fully filled. In another embodiment, filled areas 345 and 351 are all partially filled. In yet another embodiment, at least one filled area 345 and 351 are fully filled and at least one filled area 345 is partially filled.

Filled area 351 provides a platform without ribs which creates space for text, logos or images that may be embossed, engraved, painted, or stamped to provide the product name or company branding/advertising. Filled areas 345 and 351 also block a portion of apertures 325 to provide a container to help capture dispensed soap.

Outer perimeter 305, in various embodiments, includes a height/depth in the range of about 0.25 inches to about 1.0 inch. Here, rib(s) 315 and rib(s) 320 extend the entire height/depth of outer perimeter 305 (e.g., from a top side to a bottom side of cleaning apparatus 300). Similarly, aperture(s) 325 extend the entire height/depth of outer perimeter 305.

In the various embodiments, outer perimeter 305 includes any size area that is practical enough to enable to human to effectively and/or efficiently utilize cleansing apparatus 300. That is, outer perimeter 305 may include any practical dimensions formed from any length and width, circumference/diameter/radius, base and height, and the like dimensions. In one embodiment, outer perimeter 305 includes a length in the range of about 2.0 inches to about 6.0 inches and a width in the range of about 2.0 inches to about 6.0 inches. In another embodiment, outer perimeter 305 includes a diameter in the range of about 2.0 inches to about 6.0 inches. In yet another embodiment (e.g., a triangle), outer perimeter 305 includes base in the range of about 2.0 inches to about 6.0 inches and a height in the range of about 2.0 inches to about 6.0 inches.

Outer perimeter 305 further comprises a curved portion 325 configured to facilitate the formation and function of a spring system 330. Spring system 330, in various embodiments, is formed of the same material as cleansing apparatus 300 such that spring system 330 and the other portions of cleansing apparatus 300 are and/or form a single unit. In other embodiments, spring system 330 may be formed of a different material than cleansing apparatus 300 such that spring system 330 and the other portions of cleansing apparatus 300 are different pieces coupled together to form a single unit. Coupled to spring system 330 is attachment mechanism 340.

Attachment mechanism 340 may be any device and/or system capable of attaching cleansing apparatus to a foreign surface. Examples of attachment mechanism include, but are not limited to, a suction cup, a hook, hook and loop tape, a clip, a fastener, and the like devices/systems for attaching cleansing apparatus 300 to a foreign surface.

Cleansing apparatus 300 (e.g., outer perimeter 305, enclosed area 310, ribs 315/320, spring system 330, filled area(s) 345/351 and/or inner perimeter 350) comprises any material known in the art or developed in the future that is non-absorbent and/or anti-bacterial. In one embodiment, cleansing apparatus 300 is comprised of silicon. In an aspect of this embodiment, the silicon is flexible and/or substantially non-rigid in nature. In various embodiments, cleansing apparatus 300 comprises a hardness range of about 10 to about 80 durometer Shore A.

In another aspect, the silicon is an elastomer (e.g., a rubber-like material) composed of silicone, itself a polymer, comprising silicon together with carbon, hydrogen, and oxygen. This material is substantially odorless, tasteless, hypoallergenic, and includes an inorganic backbone. This material is hygienic and is resistant to bacteria and/or mold growth and includes a large range of resistance to harsh chemicals. The silicon comprises a high biocompatibility, is thermally stable with temperature range performances that may be obtained between about −148° F. and about 572° F. This large thermal range makes cleansing apparatus 100 dishwasher and washing machine safe. Cleansing apparatus 300 is also ozone safe and ultra violet safe if left outside and/or exposed to the elements.

Cleansing apparatus 300 may include any color known in the art or developed in the future. In one embodiment, cleansing apparatus 300 comprises a single color. In other embodiments, cleansing apparatus 300 comprises two or more colors.

In one embodiment, cleansing apparatus 300 is fabricated via a Liquid Injection Molding (LIM) technique using a Liquid Silicone Rubber (LSR). LIM with LSR provides a cycle time of about 5 seconds to about 6 seconds per cavity per machine, which enables the mass production of cleansing apparatus 300. Standard mold draft angles of about 5 degrees and/or greater may also be used, but are not necessary with LSR. Multi-part injection or over molding may also be utilized to provide various durometers with multiple colors within the same product. Deep thin walled ribs 315/320 may also be created with this process.

One process includes a part A component (e.g., silicon) and a part B component (e.g., carbon, hydrogen, and oxygen) that are mixed prior to the injection process. Another process includes a one-part silicone material being injection molded.

Various mold design techniques may be used to create cleansing apparatus 300. Examples of mold design techniques include, but are not limited to: cold runners, ejector pins, and ejector plates. Other variables that may be controlled to obtain fast cycle times with consistent product quality are silicone and mold injection temperatures, pressures, injection velocities, hold times, mold cooling, and the like techniques that are known in the art or developed in the future.

Figure 4:
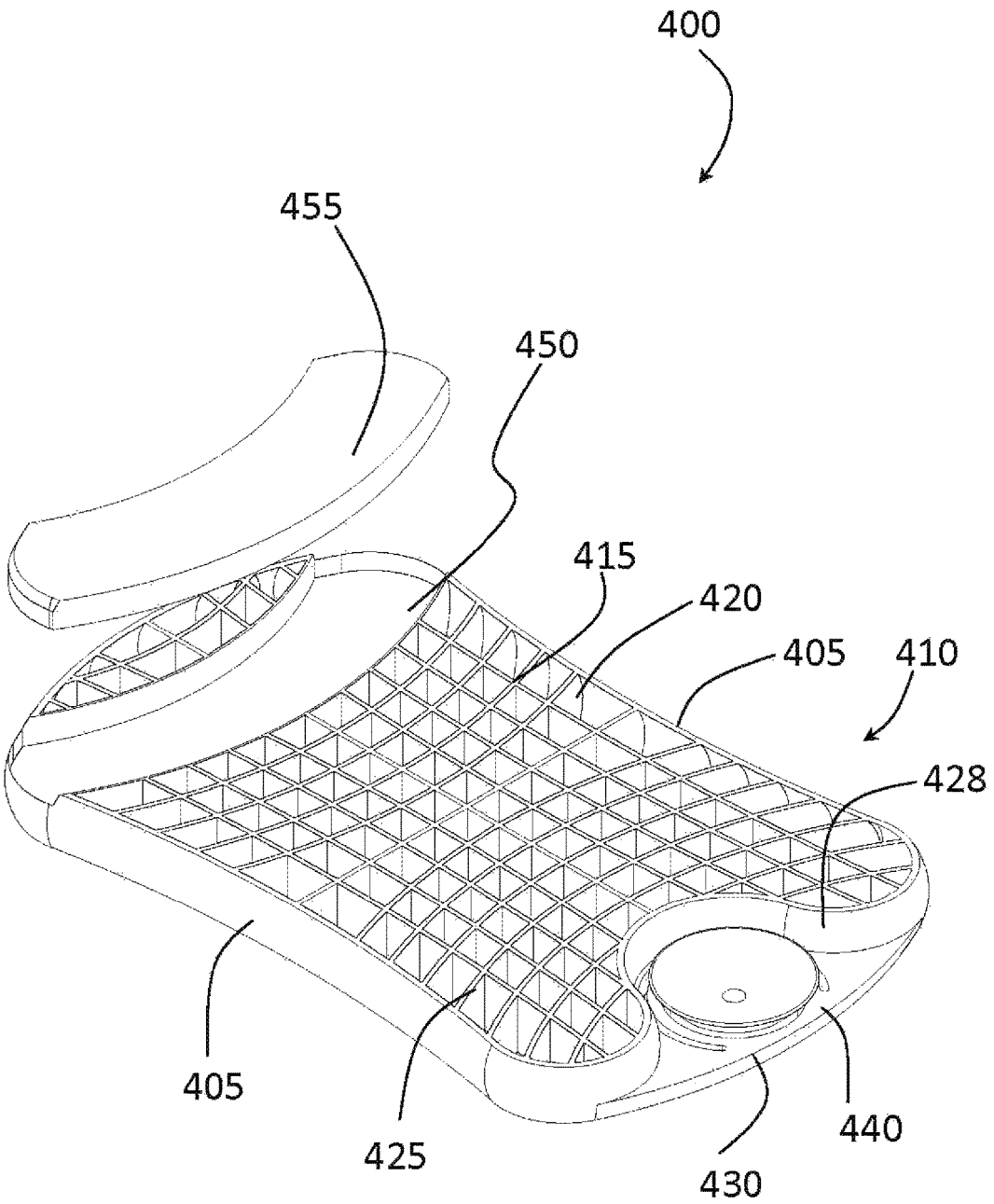
FIG. 4 is a diagram of one embodiment of a cleansing apparatus comprising an attachment/spring system and a reservoir for holding a cleansing substance

With reference to FIG. 4, FIG. 4 is a diagram of one embodiment of a cleansing apparatus 400. At least in the illustrated embodiment, cleansing apparatus 400 comprises an outer perimeter 405 defining an enclosed area 410, a spring system 430, and an attachment mechanism 440 similar to perimeters 105/205/305 defining enclosed areas 110/210/310 in FIGS. 1-3 and spring systems 230/330 in FIGS. 2-3 and attachment mechanism 340 in FIG. 3. As further illustrated in FIG. 4, cleansing apparatus 400 comprises one or more cavities 450 capable of housing/holding one or more bowled/cupped reservoirs 455 coupled to the other portions of cleansing apparatus 400.

Outer perimeter 405, in various embodiments, comprises any shape suitable for enabling a user to utilize cleansing apparatus 400. In one embodiment, outer perimeter 405 includes an ergonomic shape to enable a user to easily grip cleansing apparatus 400. For example, outer perimeter 405 may include a round shape (e.g., a circle, oval, etc.), a triangular shape, a quadrilateral shape, an hourglass shape, a shape that includes more than four sides, or the like shapes.

In various embodiments, outer perimeter 405 comprises a whimsical shape. That is, outer perimeter 405 includes a shape that makes cleansing apparatus more enjoyable to use. Examples of whimsical shapes include, but are not limited to, vehicles (e.g., an automobile, a truck, a train, an airplane, a helicopter, a ship/boat, a submarine, a spacecraft, a bicycle, and the like vehicles), animals, birds, sea creatures, humans (e.g., a police officer, a firefighter, etc.), caricatures, cartoon characters, plants/trees/flowers, symbols (e.g., a four leaf clover, a dollar sign, etc.), inanimate objects (e.g., a building, a rock formation, a historic monument, a good luck charm, etc.), and the like whimsical shapes.

Coupled to outer perimeter 405 and within enclosed area 410 is a pattern of ribs 415 and ribs 420 that form one or more apertures 425 comprising any type of pattern and/or shape known in the art or developed in the future. At least in the illustrated embodiment, cleansing apparatus 400 comprises a plurality of ribs 415 forming a plurality of rows and a plurality of ribs 420 forming a plurality of columns creating a plurality of box-shaped apertures 425. In other embodiments, ribs 415 and ribs 420 are formed to create a plurality of apertures 425 with a honeycomb shape.

Furthermore, apertures 425 may comprise any dimensions that enable material (e.g., a liquid, soap, etc.) to transport from one side to the other side of cleansing device 400 when in use. That is, apertures 425 may be relatively small apertures up to and including large apertures. In various embodiments, apertures 425 are all the same size. In other embodiments, at least two apertures 425 include different sizes. In still other embodiments, three or more apertures include different sizes. In yet other embodiments, each aperture 425 includes a different size.

As illustrated in FIG. 4, enclosed area comprises one or more cavities 450 for housing/holding one or more reservoirs 455 to hold a cleansing material (e.g., powered soap, liquid soap, etc.). Reservoir(s) 455, in various embodiments, may include any shape and/or dimensions suitable for storing and/or dispensing the cleansing material. In one embodiment, reservoir(s) 455 include a cupped and/or bowled shape to store the cleansing material and/or to dispense the cleansing material during the use of cleansing apparatus 400. Reservoirs 455, in various embodiments, may be a removable and/or replaceable pads that may be made from a material such as foam, steel wool, silk, sand paper, buffing cloth, or any substance known in the art or developed in the future for cleaning, scrubbing, sanding, polishing, or the like purposes.

The embodiment illustrated in FIG. 4 illustrates reservoir 455 as being a separate entity from cleansing apparatus 400. Other embodiments include reservoir(s) 455 being fully integrated and/or forming a portion of cleansing apparatus 400 (e.g., enclosed area 410) itself.

While FIG. 4 illustrates a single cavity 450 and a single reservoir 455, cleansing apparatus 400 is not limited to this embodiment. Moreover, while FIG. 4 illustrates cavity 450 and reservoir 455 in a particular location, cleansing apparatus 400 is not limited to this embodiment. That is, cleansing apparatus 400 may include a plurality of cavities 450 and reservoirs 455 and each cavity 450 and each reservoir 455 may be located anywhere within enclosed area 410.

Outer perimeter 405, in various embodiments, includes a height/depth in the range of about 0.25 inches to about 1.0 inch. Here, rib(s) 415 and rib(s) 420 extend the entire height/depth of outer perimeter 405 (e.g., from a top side to a bottom side of cleaning apparatus 400). Similarly, aperture(s) 425 extend the entire height/depth of outer perimeter 405.

In the various embodiments, outer perimeter 405 includes any size area that is practical enough to enable to human to effectively and/or efficiently utilize cleansing apparatus 400. That is, outer perimeter 405 may include any practical dimensions formed from any length and width, circumference/diameter/radius, base and height, and the like dimensions. In one embodiment, outer perimeter 405 includes a length in the range of about 2.0 inches to about 6.0 inches and a width in the range of about 2.0 inches to about 6.0 inches. In another embodiment, outer perimeter 405 includes a diameter in the range of about 2.0 inches to about 6.0 inches. In yet another embodiment (e.g., a triangle), outer perimeter 405 includes base in the range of about 2.0 inches to about 6.0 inches and a height in the range of about 2.0 inches to about 6.0 inches.

Outer perimeter 405 further comprises a curved portion 425 configured to facilitate the formation and function of a spring system 430. Spring system 430, in various embodiments, is formed of the same material as cleansing apparatus 400 such that spring system 430 and the other portions of cleansing apparatus 400 are and/or form a single unit. In other embodiments, spring system 430 may be formed of a different material than cleansing apparatus 400 such that spring system 430 and the other portions of cleansing apparatus 400 are different pieces coupled together to form a single unit. Coupled to spring system 430 is attachment mechanism 440.

Attachment mechanism 440 may be any device and/or system capable of attaching cleansing apparatus to a foreign surface. Examples of attachment mechanism include, but are not limited to, a suction cup, a hook, hook and loop tape, a clip, a fastener, and the like devices/systems for attaching cleansing apparatus 400 to a foreign surface.

Cleansing apparatus 400 (e.g., outer perimeter 405, enclosed area 410, ribs 415/420, spring system 430, each cavity 450 and/or reservoir(s) 455) comprises any material known in the art or developed in the future that is non-absorbent and/or anti-bacterial. In one embodiment, cleansing apparatus 400 is comprised of silicon. In an aspect of this embodiment, the silicon is flexible and/or substantially non-rigid in nature. In various embodiments, cleansing apparatus 400 comprises a hardness range of about 10 to about 80 durometer Shore A.

In another aspect, the silicon is an elastomer (e.g., a rubber-like material) composed of silicone, itself a polymer, comprising silicon together with carbon, hydrogen, and oxygen. This material is substantially odorless, tasteless, hypoallergenic, and includes an inorganic backbone. This material is hygienic and is resistant to bacteria and/or mold growth and includes a large range of resistance to harsh chemicals. The silicon comprises a high biocompatibility, is thermally stable with temperature range performances that may be obtained between about −148° F. and about 572° F. This large thermal range makes cleansing apparatus 100 dishwasher and washing machine safe. Cleansing apparatus 400 is also ozone safe and ultra violet safe if left outside and/or exposed to the elements.

Cleansing apparatus 400 may include any color known in the art or developed in the future. In one embodiment, cleansing apparatus 400 comprises a single color. In other embodiments, cleansing apparatus 400 comprises two or more colors.

In one embodiment, cleansing apparatus 400 is fabricated via a Liquid Injection Molding (LIM) technique using a Liquid Silicone Rubber (LSR). LIM with LSR provides a cycle time of about 5 seconds to about 6 seconds per cavity per machine, which enables the mass production of cleansing apparatus 400. Standard mold draft angles of about 5 degrees and/or greater may also be used, but are not necessary with LSR. Multi-part injection or over molding may also be utilized to provide various durometers with multiple colors within the same product. Deep thin walled ribs 415/420 may also be created with this process.

One process includes a part A component (e.g., silicon) and a part B component (e.g., carbon, hydrogen, and oxygen) that are mixed prior to the injection process. Another process includes a one-part silicone material being injection molded.

Various mold design techniques may be used to create cleansing apparatus 400. Examples of mold design techniques include, but are not limited to: cold runners, ejector pins, and ejector plates. Other variables that may be controlled to obtain fast cycle times with consistent product quality are silicone and mold injection temperatures, pressures, injection velocities, hold times, mold cooling, and the like techniques that are known in the art or developed in the future.

Figure 5:
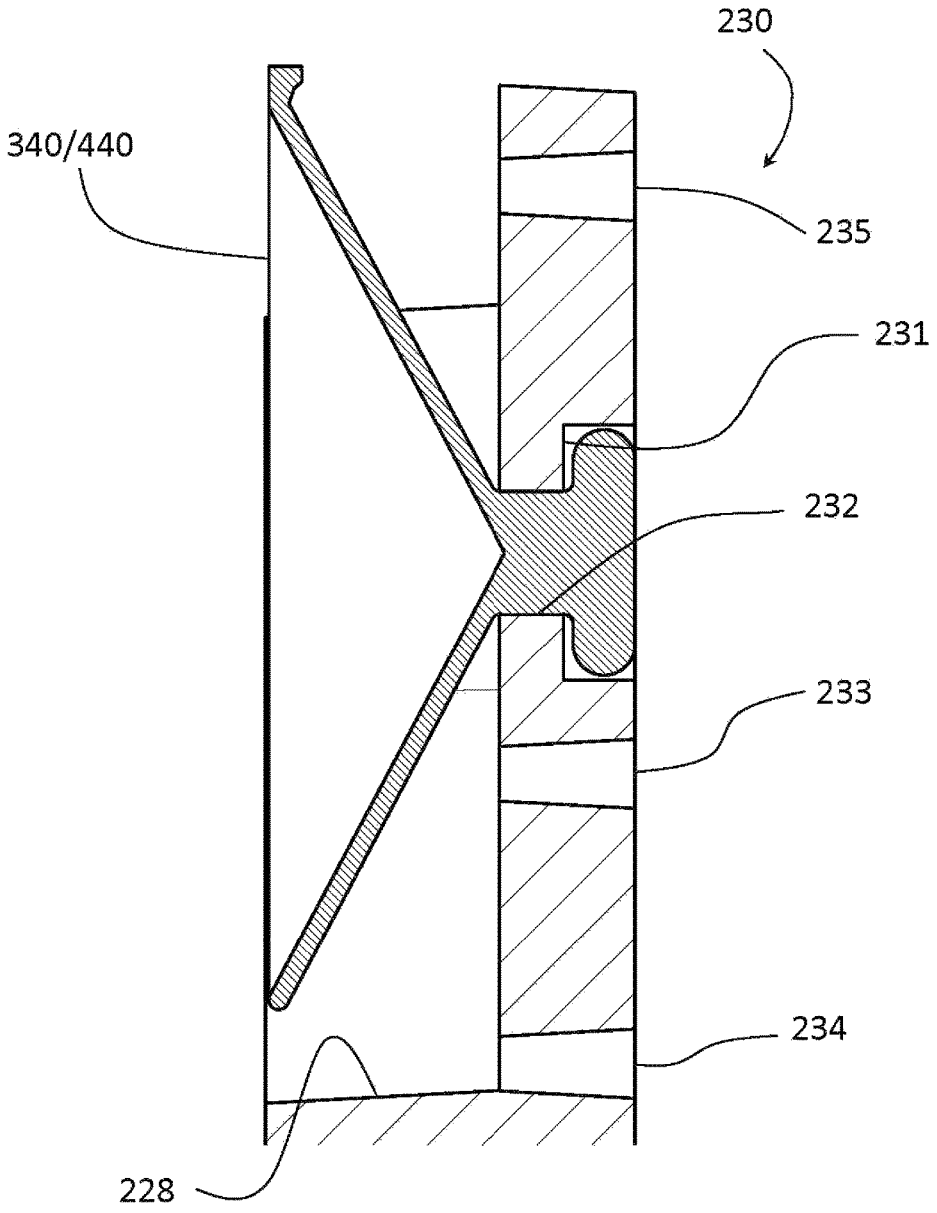
FIG. 5 is a diagram of one embodiment of an attachment/spring system in a disengaged position.

FIG. 5 is a diagram of one embodiment of spring system 230 with attachment mechanism 340/440 in a disengaged position. In this embodiment, attachment mechanism 340/440 is a suction cup housed within aperture 232. In the disengaged position, the top of attachment mechanism 340/440 is at or below the plane or level of enclosed area 210 proximate to curved portion 428. Furthermore, the portions of platform portion 231 forming the coils of the spring are retracted and channels 233, 234, and 235 are substantially uniform in depth.

Figure 6:
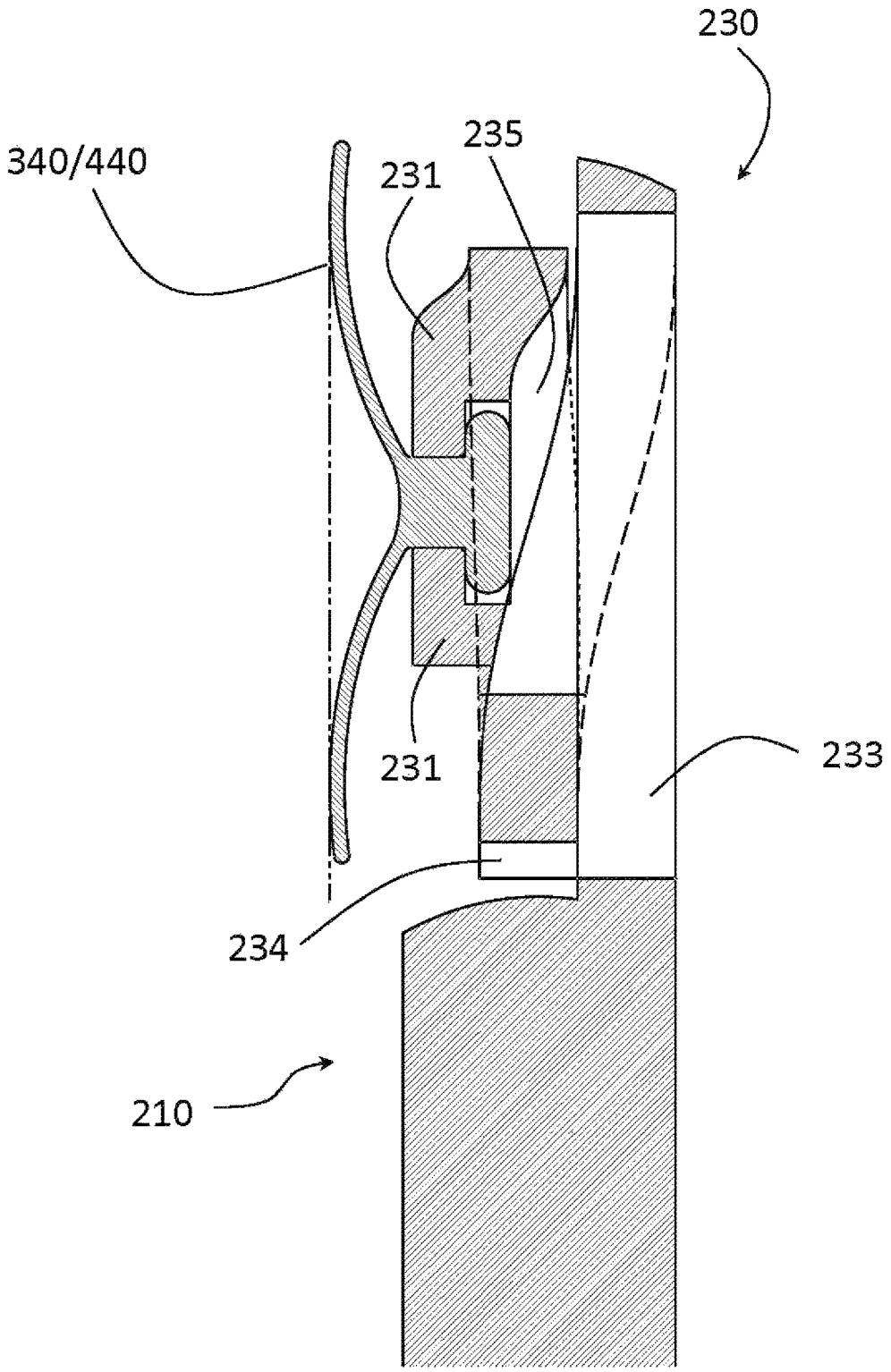
FIG. 6 is a diagram of the embodiment of the attachment/spring system of FIG. 5 in an engaged position.

FIG. 6 is a diagram of the embodiment of spring system 230 with attachment mechanism 340/440 in an engaged position. Here, the top portion of attachment mechanism 340/440 extends beyond the plane of enclosed area 210 and the portions of platform portion 231 forming the coils of the spring are extended and channels 233, 234, and 235 no longer include a uniform depth. Furthermore, the suction force of attachment mechanism 340/440 is greater than the spring force of spring system 230 such that cleansing apparatus 200 stays attached to the foreign surface. In this manner, cleansing apparatus 200 (and apparatus 300/400) is capable of being attached to a foreign surface (e.g., a vertical surface) via attachment mechanism 2340/440 so that the cleaning surfaces (e.g., enclosed areas 210/310/410) do not rest on a surface that potentially includes water and/or bacteria when cleansing apparatus 200 is not in use or is being stored, which further limits cleansing apparatus from encouraging the growth of bacteria.

In summary, various embodiments provide cleansing apparatus and systems. One cleansing apparatus comprises a perimeter surface defining an enclosed area, a first surface defining a first side and including a first plane coupled to and adjacent the perimeter surface, and a second surface opposite the first surface and defining a second side including a second plane coupled to and adjacent the perimeter surface. In one embodiment, the enclosed area comprises a spring coupled to the perimeter surface, wherein: the spring is engageable on one of the first side and the second side and extends beyond the one of the first plane and the second plane when engaged, the spring is defined and resides within the enclosed area when disengaged, and the spring is retractable within the one of the first plane and the second plane when disengaged. In various embodiments, the cleansing apparatus further comprises an attachment mechanism coupled to the spring, the attachment mechanism configured for attaching the cleansing apparatus to a foreign surface. In an embodiment, the attachment mechanism is a suction cup comprising a suction force, the spring comprises a spring force, and the suction force is greater than the spring force when the suction cup is attached to the foreign surface and the spring is engaged.

In one embodiment, the perimeter surface, the first surface, the second surface, and the spring are each formed from the same material. In one aspect, the material is an anti-bacterial and non-absorbent material. In a further aspect, the material is silicon.

In further embodiments, the first surface and/or the second surface comprises a reservoir structure formed from the same material and configured for holding and dispensing a cleansing material. In another embodiment, the perimeter surface comprises an ergonomic shape or a whimsical shape.

In various embodiments the material forming the cleansing apparatus extends from the first surface to the second surface through the enclosed area and the enclosed area comprises an aperture extending from the first surface to the second surface through the enclosed area such that liquid is capable of flowing through the aperture. In an aspect of this embodiment, the enclosed area comprises a plurality of apertures extending from the first surface to the second surface through the enclosed area such that liquid is capable of flowing through the plurality of apertures. In another aspect, each of the plurality of apertures comprises a shape. In various aspects, the shape is a circle, an oval, a triangle, a quadrilateral, a pentagon, or a hexagon. In a particular aspect, the shape is a hexagon and the plurality of apertures define a honeycomb structure or the like structure.

Another cleansing apparatus, comprises a perimeter surface defining an enclosed area, a first surface defining a first side and including a first plane coupled to and adjacent the perimeter surface, and a second surface opposite the first surface and defining a second side including a second plane coupled to and adjacent the perimeter surface. In various embodiments, the enclosed area comprises a spring coupled to the perimeter surface, wherein: the spring is engageable on the first side extends beyond the first plane when engaged, the spring is defined and resides within the enclosed area when disengaged, and the spring is retractable within the first plane when disengaged. In one embodiment, the perimeter surface, the first surface, the second surface, and the spring are each comprised of silicon and are formed as a single unit. The cleansing apparatus, in various embodiments, further comprises a suction cup coupled to the spring and configured for attaching the cleansing apparatus to a foreign surface, wherein: the suction cup comprises a suction force, the spring comprises a spring force, and the suction force is greater than the spring force when the suction cup is attached to the foreign surface and the spring is engaged.

One system comprises a spring formed on a cleansing apparatus. The spring is defined and resides within a side of the cleansing apparatus when disengaged, is engageable on the side and extends beyond a plane of the side when engaged, and is retractable within the plane when disengaged. The system further comprises an attachment mechanism coupled to the spring and configured for attaching the cleansing apparatus to the foreign surface.

In one embodiment, the spring and the cleansing apparatus are both formed from the same material and are formed as a single unit. In one aspect, the same material is an anti-bacterial and non-absorbent material. In another aspect, the anti-bacterial and non-absorbent material is silicon.

In another embodiment, the attachment mechanism is a suction cup comprising a suction force, the spring comprises a spring force, and the suction force is greater than the spring force when the suction cup is attached to the foreign surface and the spring is engaged. In still another embodiment, the attachment mechanism is one of a hook, hook and loop tape, a clip, and a fastener.

As will be appreciated by one skilled in the art, aspects of the present invention may be embodied as an apparatus, system, or method. The flowcharts and/or block diagrams in the above figures illustrate the architecture, functionality, and operation of possible implementations of apparatus, systems, and methods according to various embodiments of the present invention. In this regard, each block in the diagrams may represent a module, segment, or portion of the apparatus, systems, and methods. It should also be noted that, in some alternative implementations, the functions noted in the blocks may occur out of the order noted in the figures.

Although the invention has been described with respect to particular embodiments, such embodiments are for illustrative purposes only and should not be considered to limit the invention. Various alternatives and changes will be apparent to those of ordinary skill in the art upon reading this Application.

The invention claimed is:

1. A cleansing apparatus, comprising:

a perimeter surface defining an enclosed area;

a first surface defining a first side and including a first plane coupled to and adjacent the perimeter surface;

a second surface opposite the first surface and defining a second side including a second plane coupled to and adjacent the perimeter surface, wherein the perimeter surface, the first surface, and the second surface comprise one of an anti-bacterial and a non-absorbent material;

wherein the enclosed area comprises:

a spring coupled to the perimeter surface, wherein:

the spring is engageable on one of the first side and the second side and extends beyond the one of the first plane and the second plane when engaged, the spring is defined and resides within the enclosed area when disengaged, and the spring is retractable within the one of the first plane and the second plane when disengaged;

an attachment mechanism coupled to the spring, the attachment mechanism configured for attaching the cleansing apparatus to a foreign surface; and wherein the perimeter surface, the first surface, the second surface, and the spring are each formed from a same material.

2. The cleansing apparatus of claim 1, wherein:

the attachment mechanism is a suction cup comprising a suction force;

the spring comprises a spring force; and the suction force is greater than the spring force when the suction cup is attached to the foreign surface and the spring is engaged.

3. The cleansing apparatus of claim 1, wherein the one of the anti-bacterial and the non-absorbent material is silicon.

4. The cleansing apparatus of claim 3, wherein:

the same material extends from the first surface to the second surface through the enclosed area; and the enclosed area comprises an aperture extending from the first surface to the second surface through the enclosed area such that liquid is capable of flowing through the aperture.

5. The cleansing apparatus of claim 4, wherein the enclosed area comprises a plurality of apertures extending from the first surface to the second surface through the enclosed area such that liquid is capable of flowing through the plurality of apertures.

6. The cleansing apparatus of claim 5, wherein each of the plurality of apertures comprises a shape.

7. The cleansing apparatus of claim 6, wherein the shape is one of a circle, an oval, a triangle, a quadrilateral, a pentagon, and a hexagon.

8. The cleansing apparatus of claim 7, wherein the shape is a hexagon and the plurality of apertures define a honeycomb structure.

9. The cleansing apparatus of claim 1, wherein one of the first surface and the second surface comprises a membrane structure formed from the same material and configured for holding and dispensing a cleansing material.

10. The cleansing apparatus of claim 1, wherein the perimeter surface comprises an ergonomic shape.

11. The cleansing apparatus of claim 1, wherein the perimeter surface comprises a whimsical shape.

12. A cleansing apparatus, comprising:

an outer perimeter surface defining an enclosed area;

a first surface defining a first side and including a first plane coupled to and adjacent the outer perimeter surface;

a second surface opposite the first surface and defining a second side including a second plane coupled to and adjacent the outer perimeter surface, the enclosed area comprising:

a spring coupled to the outer perimeter surface, wherein:

the spring is engageable on the first side extends beyond the first plane when engaged, the spring is defined and resides within the enclosed area when disengaged, and the spring is retractable within the first plane when disengaged, and the outer perimeter surface, the first surface, the second surface, and the spring are each comprised of silicon and are formed as a single unit, and a suction cup coupled to the spring and configured for attaching the cleansing apparatus to a foreign surface, wherein:

the suction cup comprises a suction force, the spring comprises a spring force, and the suction force is greater than the spring force when the suction cup is attached to the foreign surface and the spring is engaged; and an outer perimeter for providing a cavity to allow at least one of text and a logo.

* * * * *